US005819372A

United States Patent [19]

Magoon

[11] Patent Number: 5,819,372

[45] Date of Patent: Oct. 13, 1998

[54] BUTT HINGE WITH INTEGRALLY FORMED BUTT STRAPS

[75] Inventor: Robert Dean Magoon, Duluth, Ga.

[73] Assignee: Microsoft Corporation, Redmond, Wash.

[21] Appl. No.: 771,868

[22] Filed: Dec. 23, 1996

[51] Int. Cl.[6] ..... E05D 5/00

[52] U.S. Cl. ..... 16/382; 16/380; 16/254

[58] Field of Search ..... 16/382, 380, 386, 16/387, 254, DIG. 40, DIG. 43, DIG. 29; 49/504, 381, 399

[56] References Cited

U.S. PATENT DOCUMENTS

| | | | |
|---|---|---|---|
| 1,660,657 | 2/1928 | Regan . | |
| 1,860,438 | 5/1932 | Thies | 16/254 |
| 3,263,269 | 8/1966 | McGahee . | |
| 3,733,649 | 5/1973 | Nagy et al. . | |
| 4,087,942 | 5/1978 | Herrmann . | |
| 4,304,027 | 12/1981 | Di Fazio . | |
| 4,547,930 | 10/1985 | King et al. | 16/382 |
| 4,553,286 | 11/1985 | Schwarz, II | 16/382 |
| 4,683,613 | 8/1987 | Starke . | |
| 4,803,756 | 2/1989 | Hufnagel . | |
| 4,825,507 | 5/1989 | Killingstad . | |
| 4,825,509 | 5/1989 | Mitchell et al. | 16/382 |
| 5,193,308 | 3/1993 | Davidian . | |
| 5,337,453 | 8/1994 | Bargesser . | |
| 5,347,686 | 9/1994 | Tyler et al. . | |

*Primary Examiner*—Chuck Mah
*Attorney, Agent, or Firm*—Jones & Askew, LLP

[57] ABSTRACT

An improved butt hinge is disclosed in which each hinge half comprises a leaf portion formed integrally with a butt strap. A second leaf portion mounts to each butt strap after the butt straps are mounted to a door and door frame. A hinge pin passes through each of the four leaf portions to hingedly mount the door to the door frame. The hinge pin cannot be removed without removing at least one of the second leaf portions, and since the second leaf portions cannot be removed while the door is closed, the hinge pin cannot be removed while the door is closed.

5 Claims, 8 Drawing Sheets

BUTT HINGE WITH INTEGRALLY FORMED BUTT STRAPS

TECHNICAL FIELD

The present invention relates generally to hinges, and relates more specifically to an improved butt hinge for use with metal doors wherein the hinge has an integrally formed butt strap.

BACKGROUND OF THE INVENTION

A butt hinge is a hinge which is secured to the edge of a door and the face of its corresponding jamb. The two parts, or leaves, of the hinge meet when the door is closed. For both functional and aesthetic reasons, the hinge is typically mortised into the door and jamb to make the outer surface of the leaves flush with the surfaces of the door and jamb.

Mortising a butt hinge into a wooden door and jamb is straightforward: the mortise is cut, the hinge is positioned within the mortise, and screws are inserted through holes in the leaves and anchored into the underlying wood. However, when the door, frame, or both are hollow, as is the case with metal doors used in many commercial installations, mortising the door or frame creates a hole in the structure, leaving no material underneath the mortise into which mounting screws can be anchored. Accordingly, a reinforcing butt strap must be installed within the hollow door across the mortised opening. The butt strap is anchored to the door with screws above and below the opening. The corresponding hinge leaf is positioned within the mortise cutout and secured by screws inserted through the hinge leaf and anchored into the underlying butt strap.

There are a number of disadvantages inherent using a butt strap to anchor a hinge leaf within a cut-out in a hollow door. First, the butt strap is a separate component which must be extruded, fabricated, and taken to the job site. Second, since the butt strap is a separate component, the structural assembly depends upon the connection between the butt strap and the hinge; if the screws loosen, the integrity of the mounting of the hinge to the butt strap is compromised. Third, it is difficult to install conventional butt straps. Because it is impossible to hold the butt strap in place with one's fingers while the screws are driven through the door stile and butt strap, conventional practice calls for driving a screw partway into the butt strap to provide a grip by which the butt strap can be held while it is mounted to the door stile. The screw then subsequently has to be removed before the hinge can be mounted to the butt strap. This procedure of installing a separate screw and then removing it after the butt strap is mounted is labor-intensive and time consuming.

Thus there is a need to minimize the number of parts which must be handled and installed to mount a butt hinge.

There is also a need for a butt hinge in which the structural interconnection between the hinge leaf and the butt strap is not dependent upon a screw connection.

There is a further need for a butt hinge which does not require a screw to be mounted to the butt strap by which the installer can hold the butt strap while it is mounted within the mortise.

Another problem associated with prior art butt hinges concerns the need in certain installations to make the hinge pins non-removable. To render a hinge pin non-removable in a conventional butt hinge, it is typically necessary to install a pin or set screw in the knuckle which is inaccessible when the door is closed. While these designs are effective once installed, the installation tends to be labor intensive, as it requires fabrication of the pin or set screw, fabrication of a smooth or threaded bore, as appropriate, through the knuckle, and an additional step to install the pin or set screw. Further, should it become necessary to repair of replace the hinge, the pin or set screw must be removed before the hinge can be removed. In addition, there is the further problem of having to stock additional parts. There is always the possibility that the hinge may arrive at the job site without the necessary pin or set screw, or that the pin or set screw will become lost before it is installed.

Thus there is a need for an improved butt hinge wherein the hinge pin is non-removable without the need for additional installation steps and without the need for additional parts.

In addition, installation of the pin or set screw may require additional tools beyond those normally required to install a hinge. This need for a separate tool imposes an additional burden on the installer to insure that he has the proper tool at the job site, for if the additional tool is not available, it will not be possible to make the hinge pin non-removable.

Thus, there is a further need for an improved butt hinge design in which the hinge pin is rendered non-removable without the need for any additional tools beyond those customarily needed to install a hinge.

SUMMARY OF THE INVENTION

The present invention relates to an improved butt hinge for pivotably mounting a door to a hollow door frame. A butt strap traverses an opening in the hollow door frame member and is mounted to the inner surface of the member. A butt strap leaf having at least one knuckle is formed integrally with the butt strap and is disposed within and occupies a portion of the opening in the hollow door frame member. A second butt strap traverses an opening in the hollow door stile and is mounted to the inner surface of the door stile. A butt strap leaf having at least one knuckle is formed integrally with the second butt strap and is disposed within and occupies a portion of the opening in the hollow door stile. A filler quarter comprising a leaf having at least one knuckle is mounted to the butt strap of the hollow door frame, the leaf of the first filler quarter being disposed within and occupying a portion of the opening in the hollow door frame member. Similarly, a filler quarter comprising a leaf having at least one knuckle with an integral hinge pin is also mounted to the butt strap of the door stile, the leaf of the second filler quarter being disposed within and occupying a portion of the opening in the hollow door stile. The knuckles of the butt strap leaves and the leaves of the filler quarters are coaxially aligned, and a hinge pin extends through the knuckles to pivotably attach the door to the door frame.

DETAILED DESCRIPTION OF THE DISCLOSED EMBODIMENT

Figures 1A, 1B, 1C, 2A, 2B, 2C:
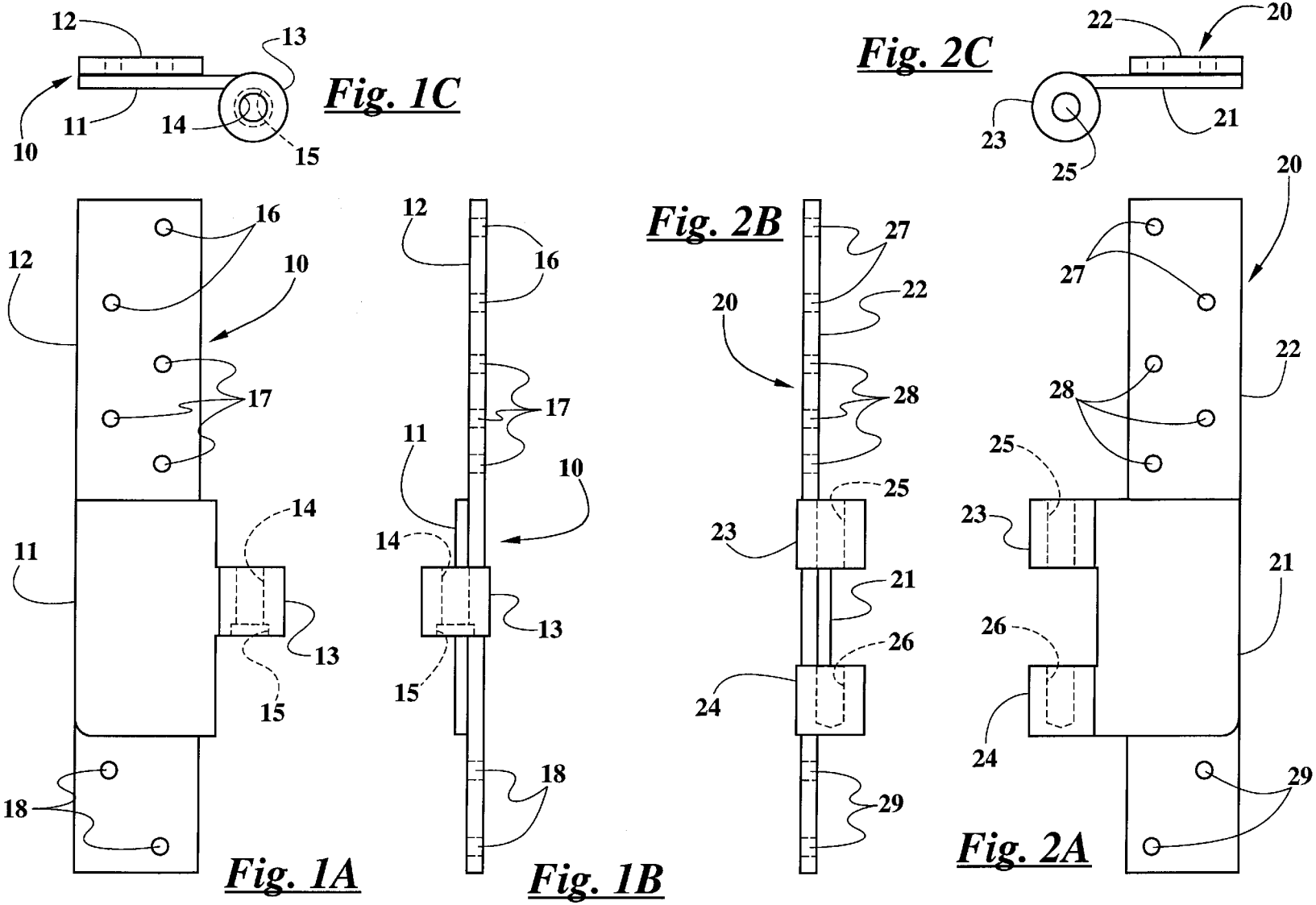
FIG. 1A is a front view of a door frame strap quarter of an improved butt hinge of the disclosed embodiment.
FIG. 1B is a side view of the door frame strap quarter of FIG. 1A.
FIG. 1C is a top view of the door frame strap quarter of FIG. 1A.
FIG. 2A is a door stile strap quarter of an improved butt hinge of the disclosed embodiment.
FIG. 2B is a side view of the door stile strap quarter of FIG. 2A.
FIG. 2C is a top view of the door stile strap quarter of FIG. 2A.

Referring now to the drawings, in which like numerals indicate like elements throughout the several views, FIGS. 1A–C show a door frame strap quarter 10, comprising a leaf 11 and a butt strap 12 formed integrally with the leaf. The leaf 11 includes a cylindrical knuckle 13 having a vertical through bore 14. A counterbore 15 is formed at the lower end of the through bore 14. A plurality of threaded upper mounting holes 16, central mounting holes 17, and lower mounting holes 18 are formed in the integral butt strap 12.

Referring now to FIG. 2A, a door stile strap quarter 20 comprises a leaf 21 and an integral butt strap 22. The leaf 21 comprises an upper cylindrical knuckle 23 and a lower cylindrical knuckle 24. The upper knuckle 23 has a smooth through bore 25 extending through it. The lower knuckle 24 has a clear bore 26 in coaxial alignment with the smooth bore 25 in the upper knuckle 23. The clear bore 26 in the lower knuckle 24 does not extend all the way through the lower knuckle but terminates at a location spaced upward from the bottom wall of the lower knuckle. Threaded upper mounting holes 27, central mounting holes 28, and lower mounting holes 29 are formed in the integral butt strap 22.

Figure 3C:
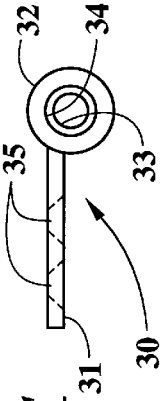
FIG. 3C is a top view of the door frame filler quarter of FIG. 3A.
Figure 3A:
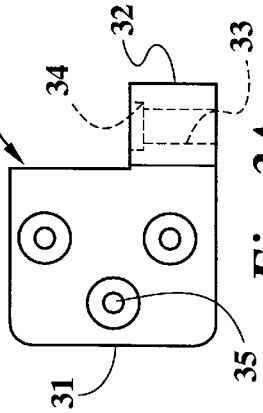
FIG. 3A is a front view of a door frame filler quarter of the improved butt hinge of the disclosed embodiment.
Figure 3B:
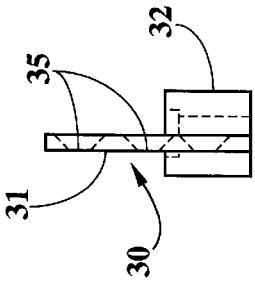
FIG. 3B is a side view of the door frame filler quarter of FIG. 3A.

Referring now to FIGS. 3A–C, a door frame filler quarter 30 comprises a leaf 31 and a cylindrical knuckle 32. The bottom edge of the knuckle 32 is substantially flush with the bottom edge of the leaf 31. A smooth through bore 33 extends through the knuckle 32, and a counterbore 34 is formed in the upper end of the bore 33. A plurality of smooth mounting holes 35 are formed in the leaf 31. The outer portions of the holes 35 have an industry-standard 82° countersink.

Figure 4C:
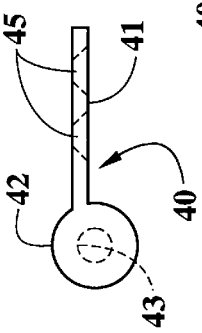
FIG. 4C is a top view of the door stile filler quarter of FIG. 4A.
Figure 4A:
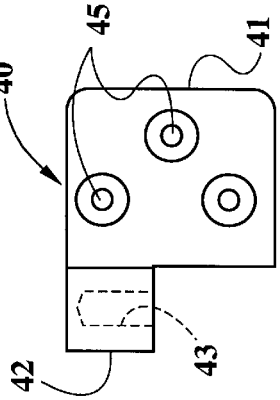
FIG. 4A is a front view of a door stile filler quarter of the improved butt hinge of the disclosed embodiment.
Figure 4B:
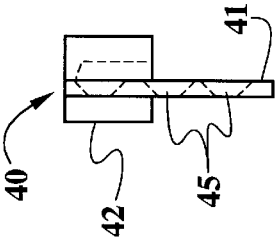
FIG. 4B is a side view of the door stile filler quarter of FIG. 4A.

FIGS. 4A–C depict a door stile filler quarter 40 having a leaf 41 and a cylindrical knuckle 42. The upper edge of the knuckle 42 is substantially flush with the upper edge of the leaf 41. A clear bore 43 is formed in the lower end of the knuckle 42 and terminates within the knuckle. A plurality of mounting holes 45 are formed in the leaf 41. The outer portions of the holes 45 have an industry-standard 82° countersink.

Figure 5:
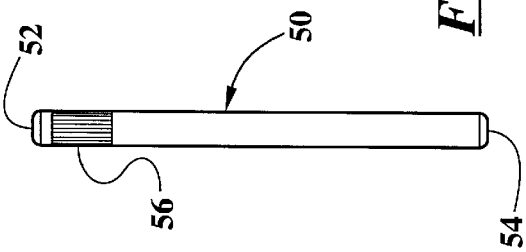
FIG. 5 is a side view of a hinge pin for the improved butt hinge of the disclosed embodiment.

FIG. 5 shows a hinge pin 50 comprised of stainless steel. The upper end 52 and lower end 54 of the hinge pin 50 are chamfered to facilitate assembly. A knurled band 56 is formed adjacent the upper end 52 of the hinge pin 50.

Figure 6B:
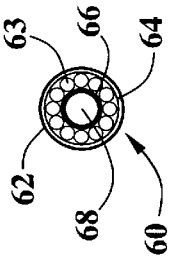
FIG. 6B is a top view of the bearing of FIG. 6A.
Figure 6A:
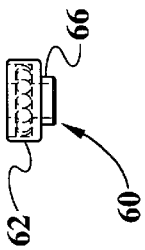
FIG. 6A is a side view of a bearing of the butt hinge of the disclosed embodiment.

Referring now to FIGS. 6A and 6B, a bearing 60 comprises a bearing housing 62. A plurality of ball bearings 63 roll within a raceway 64 which is press-fit within the housing 62. A sleeve 66 extends from the raceway 64 beyond the bearing housing 62 and is chamfered at its lower end to facilitate assembly. A smooth bore 68 extends through the sleeve 66.

The door frame strap quarter 10, the door stile strap quarter 20, the door frame filler quarter 30, and the door stile filler quarter 40 of the disclosed embodiment are all formed from steel. The components can be painted and baked with bearings 60 installed or can be plated in brass, chrome, or nickel prior to installation of the bearings.

Figure 7:
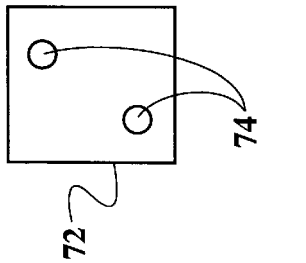
FIG. 7 is a front view of a door frame strap shim of the butt hinge of the disclosed embodiment.

FIG. 7 shows a door frame strap shim 70 comprising a plate 72 having a pair of through bores 74 extending therethrough. The through bores 74 in the door frame strap shim 70 are disposed in the same relationship as the upper mounting holes 16 and lower mounting holes 18 in the door frame strap quarter 10, for reasons which will be explained below.

Figure 8:
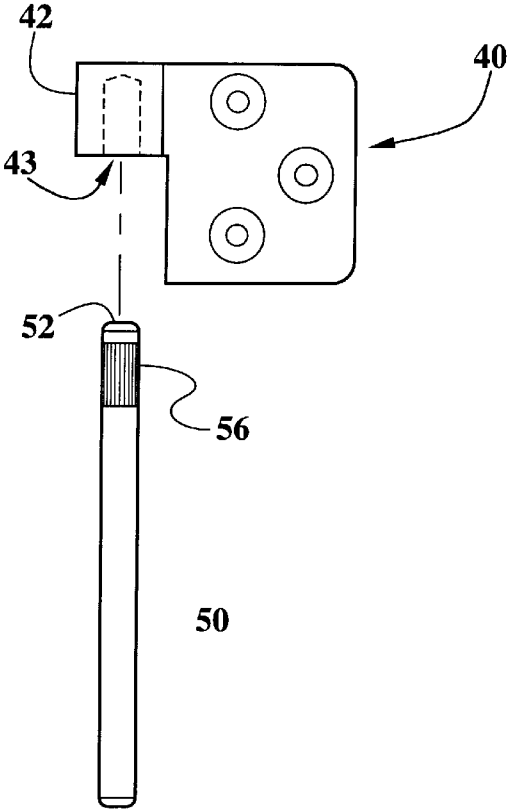
FIG. 8 is a front view showing the installation of the hinge pin of FIG. 5 into the door stile filler quarter of FIGS. 4A–C to make a hinge pin assembly.

Assembly of the butt hinge to mount a door to a door frame will now be explained with reference to FIGS. 8–18. Referring first to FIG. 8, the upper end 52 of the hinge pin 50 is inserted into the lower end of the bore 43 in the knuckle 42 of the door stile filler quarter 40. The hinge pin 50 is mounted fast to the door stile filler quarter 40 by way of an interference fit between the upper portion of the hinge pin 50 and the walls of the bore 43, enhanced by the teeth of the knurled band 56 adjacent the upper end of the hinge pin biting into the walls of the bore 43. When thus assembled, the door stile filler quarter 40 with hinge pin 50 mounted thereto comprises a hinge pin assembly 80 (FIG. 10).

Figure 9:
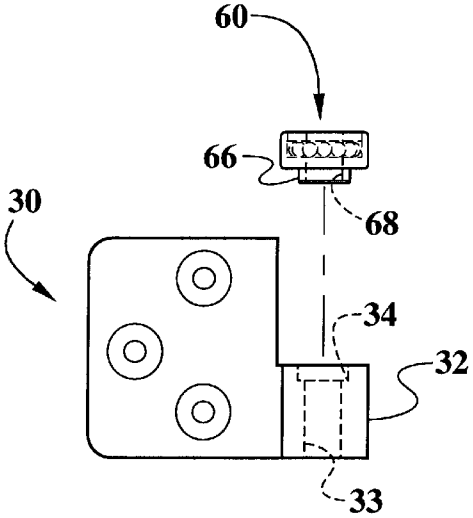
FIG. 9 is a front view showing the installation of the bearing of FIGS. 6A and 6B onto the door frame filler quarter of FIGS. 3A–C to make a door frame filler quarter and bearing assembly.

Referring now to FIG. 9, the sleeve 66 of a bearing 60 is inserted into the counterbore 34 in the upper end of the knuckle 32 of the door frame filler quarter 30. The bearing 60 is held snugly atop the knuckle 32 of the door frame filler quarter 30 by way of an interference fit between the sleeve 66 of the bearing 60 and the walls of the counterbore 34. With the bearing 60 thus mounted to the knuckle 32 of the door frame filler quarter 30, the through bore 68 of the bearing 60 is coaxially aligned with the through bore 33 in the knuckle 32 of the door frame filler quarter 30. When thus assembled, the door frame filler quarter 30 and bearing 60 form a door frame filler quarter and bearing assembly 82 (FIG. 10).

Figure 10:
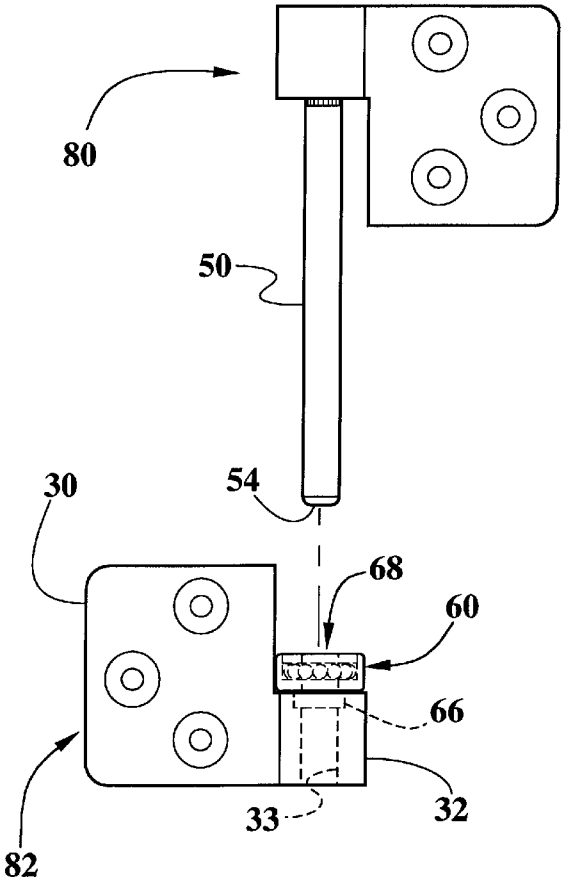
FIG. 10 is a front view showing the assembly of the hinge pin assembly of FIG. 8 together with the door frame filler quarter and bearing assembly of FIG. 9.

Referring now to FIG. 10, the hinge pin assembly 80 is assembled onto to the door frame filler quarter and bearing assembly 82. The lower end 54 of the hinge pin 50 is advanced through the bore 68 in the sleeve 66 of the bearing 60 and then through the bore 33 in the knuckle 32 of the door frame filler quarter 30.

Figure 11:
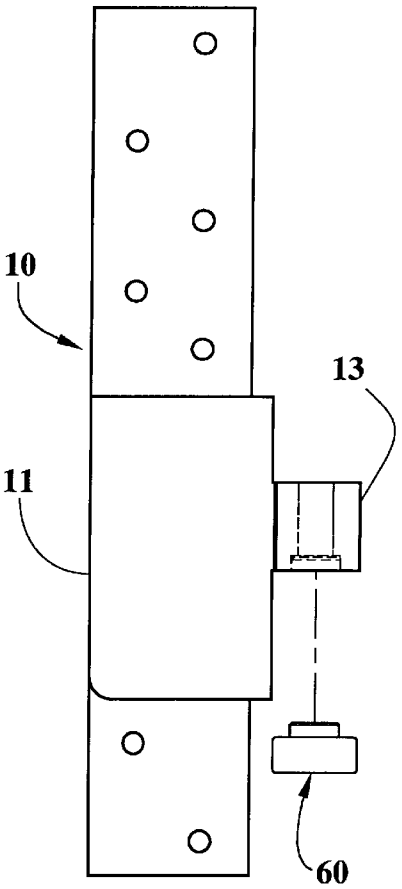
FIG. 11 is a side view illustrating the assembly of the bearing of FIGS. 6A–B being assembled onto the door frame strap quarter of FIGS. 1A–C.

FIG. 11 shows the installation of a bearing 60 onto the lower end of the knuckle 13 of the door frame strap quarter 10. The sleeve 66 of the bearing 60 is pressed-fit into the counterbore 15 of the knuckle 13. The bearing is held in place beneath the lower end of the knuckle by an interference fit between the sleeve 66 and the walls of the counterbore 15. When the bearing 60 is installed onto the knuckle 13, the through bore 14 in the knuckle and the through bore 68 in the sleeve 66 of the bearing are coaxially aligned.

Figure 12:
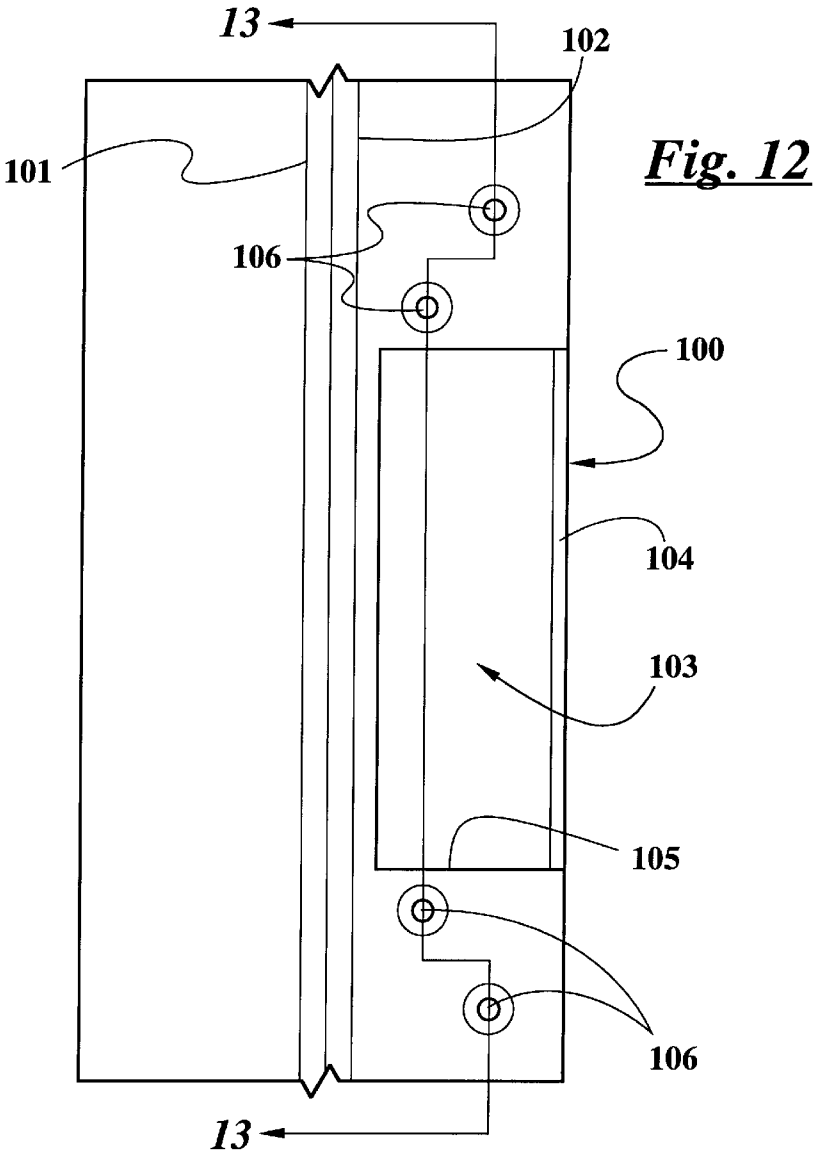
FIG. 12 is a side view of a door frame with mortise cut-out to which the improved butt hinge of the disclosed embodiment is mounted.

FIG. 12 shows a hollow metal door frame 100 of the general type with which the improved butt hinge of the disclosed embodiment is intended to be used. The door frame 100 comprises a stop 101 which extends around the inside of the door frame. A gasket 102 is mounted to the stop 101. The door frame 100 has a rectangular cut-out or mortise 103. The wall 104 which forms the exterior surface of the door frame 100 can be seen through the mortise 103. The mortise 103 has a bottom wall 105. A plurality of smooth bores 106 with 82° countersinks are formed in the door frame 100. The relationship among the various holes 106 is the same as the relative configuration of the threaded upper and lower mounted holes 16, 18 on the butt strap 12 of the door frame strap quarter 10. As is customary in the industry, a template (not shown) is employed to make the mortise 103 the proper size and shape and to position the holes 106 properly with respect to the mortise 103 and with respect to one another.

Figure 15:
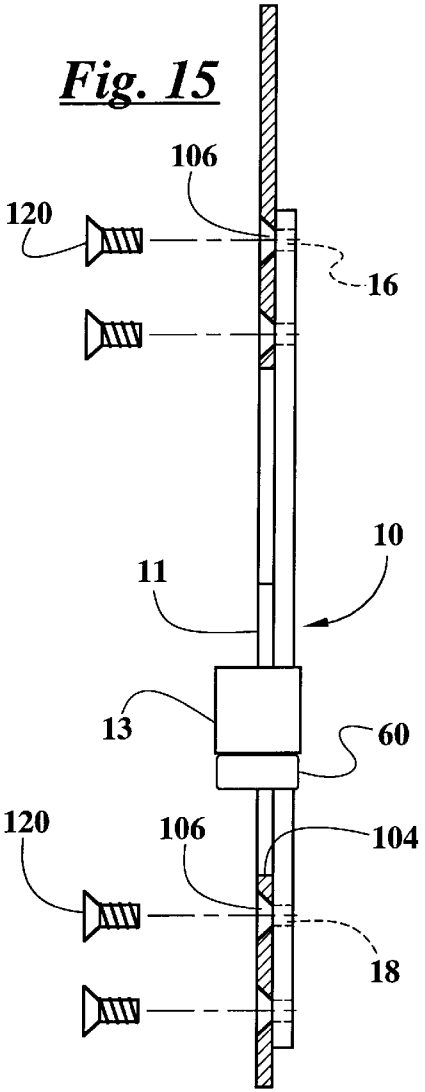
FIG. 15 is a side cut-away view of the door frame showing a third step in the installation of the door frame strap quarter onto the door frame.
Figure 14:
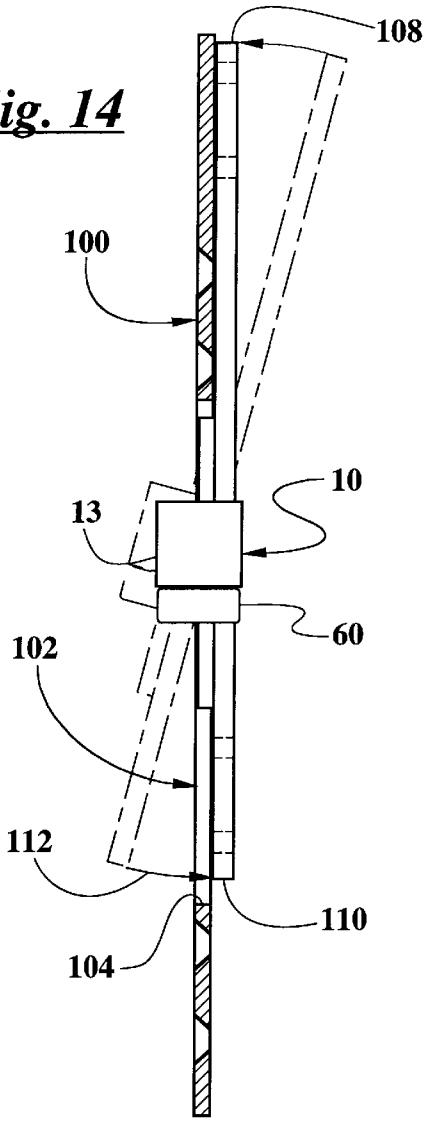
FIG. 14 is a side cut-away view of the door frame showing a second step in the installation of the door frame strap quarter onto the door frame.
Figure 13:
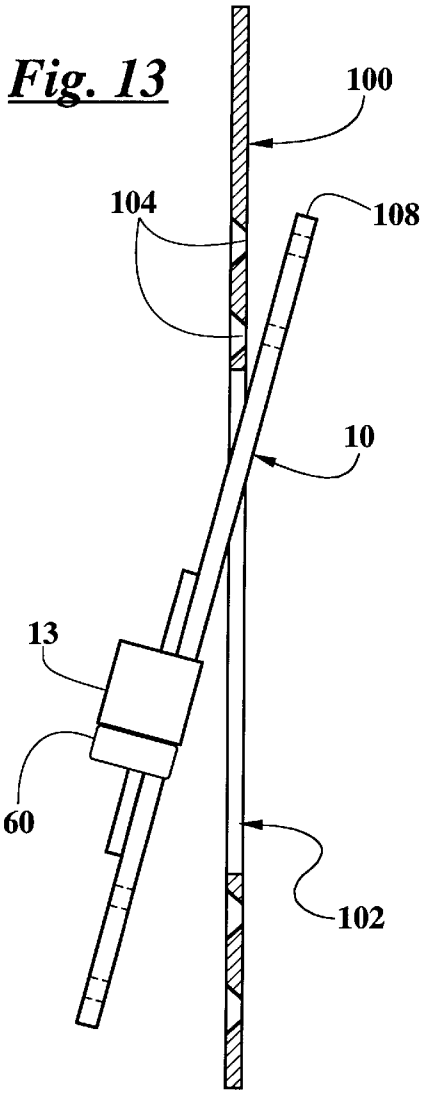
FIG. 13 is a side cut-away view of a door frame taken along line 13—13 of FIG. 12, illustrating a first step in installing the door frame strap quarter of FIGS. 1A–C onto the door frame.

The mounting of a door frame strap quarter 10 to a door frame 100 will now be explained with respect to FIGS. 13–15. Referring first to FIG. 13, the installer grasps the door frame quarter 10 by the knuckle 13 to maneuver the butt strap 12 into position within the mortise 103 of the door frame 100. The upper end 108 of the butt strap 12 of the door frame strap quarter 10 is angled forward and inserted upward through the mortise 103 and the door frame 100. When the door frame strap quarter 10 has been advanced a sufficient distance such that the lower end 110 of the butt strap 12 will clear the lower edge 104 of the mortise 103, the door frame strap quarter 10 is rotated in the direction indicated by the arrows 112 to advance the lower end 110 of the door frame strap quarter through the mortise 103, as shown in FIG. 14. Then, as shown in FIG. 15, the door frame strap quarter 10 is moved downward, with the door frame strap quarter in a vertical orientation and the lower end 110 of the butt strap 12 of the door frame strap quarter being located inside the door frame 100. The door frame strap quarter 10 is moved downward until the lower edge of the leaf 11 of the door frame strap quarter 10 rests on the lower edge 104 of the mortise 103. In this position, the through holes 106 in the door frame 100 are aligned with the upper and lower threaded mounting holes 16, 18 in the butt strap 12 of the door frame strap quarter 10. Threaded fasteners 120 are advanced through the holes 106 in the door frame and threaded into the mounting holes 16, 18 in the butt strap 12, tightening the door frame strap quarter 10 up against the inner surface of the door frame 100 and securing the door frame strap quarter to the door frame.

A door stile strap quarter 20 is mounted within a mortise of a hollow stile 128 of a door 130 in the same manner as hereinabove described with respect to the mounting of the door frame strap quarter 10 within a hollow door frame 100.

Figure 16:
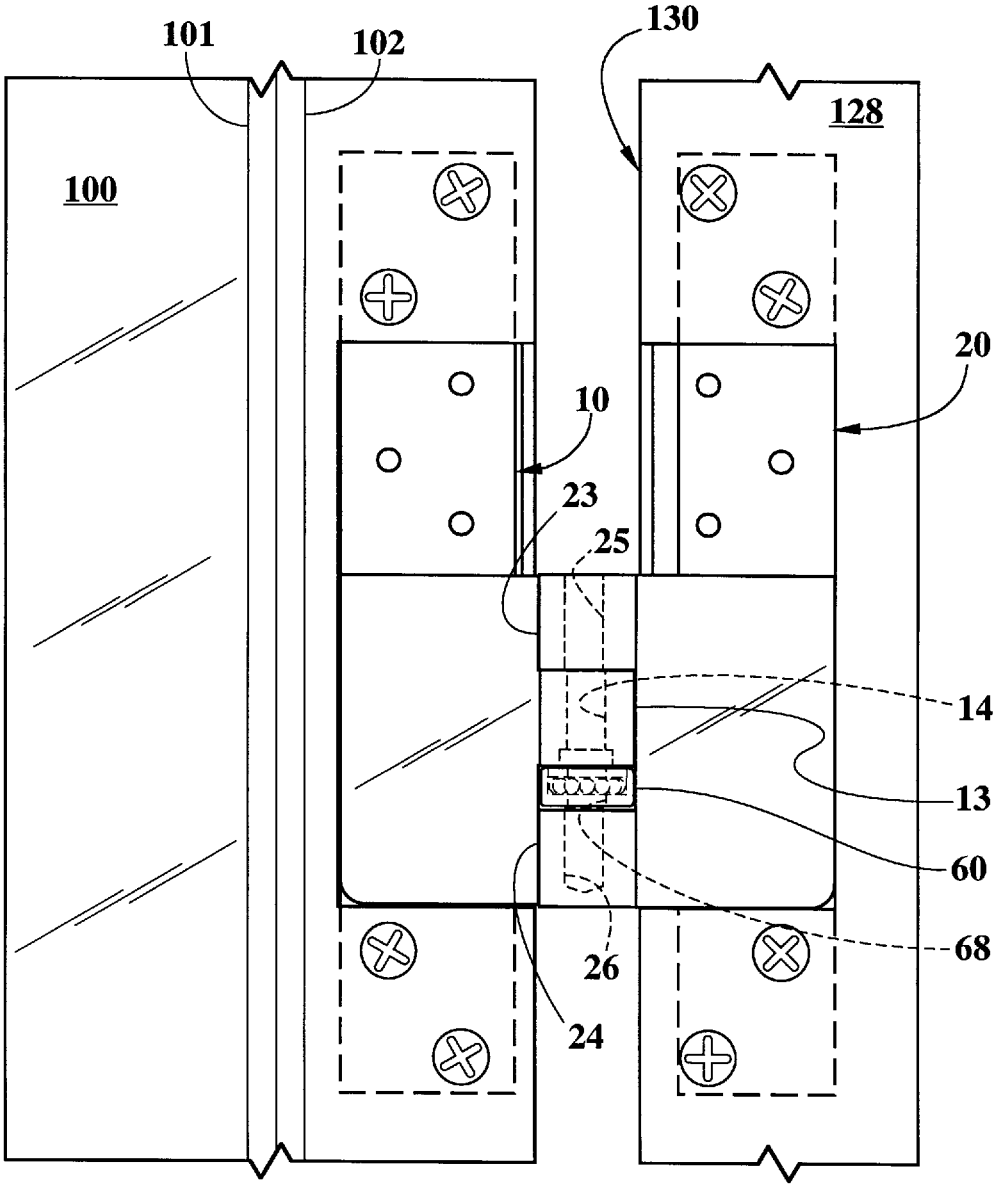
FIG. 16 is a side view which shows the door frame strap quarter mounted to the door frame of FIG. 12, the door stile strap quarter mounted to a door stile, and the knuckle of the door stile strap quarter being mated with the knuckles of the installed door frame strap quarter.

Referring now to FIG. 16, with the door stile strap quarter 20 mounted to a door stile 128, the door 130 is maneuvered to bring the door stile strap quarter 20 into mating relation to the door frame strap quarter 10. The knuckle 13 and bearing 60 of the door frame strap quarter 10 are captured between the upper knuckle 23 and the lower knuckle 24 of the door stile strap quarter 20. In this position, the through bore 25 in the upper knuckle 23 of the door stile strap quarter 20, the through bore 14 in the knuckle 13 of the door frame strap quarter 10, the through bore 68 in the sleeve 66 of the bearing 60, and the clear bore 26 in the lower knuckle 24 of the door stile strap quarter 20 are coaxially aligned.

Figure 17:
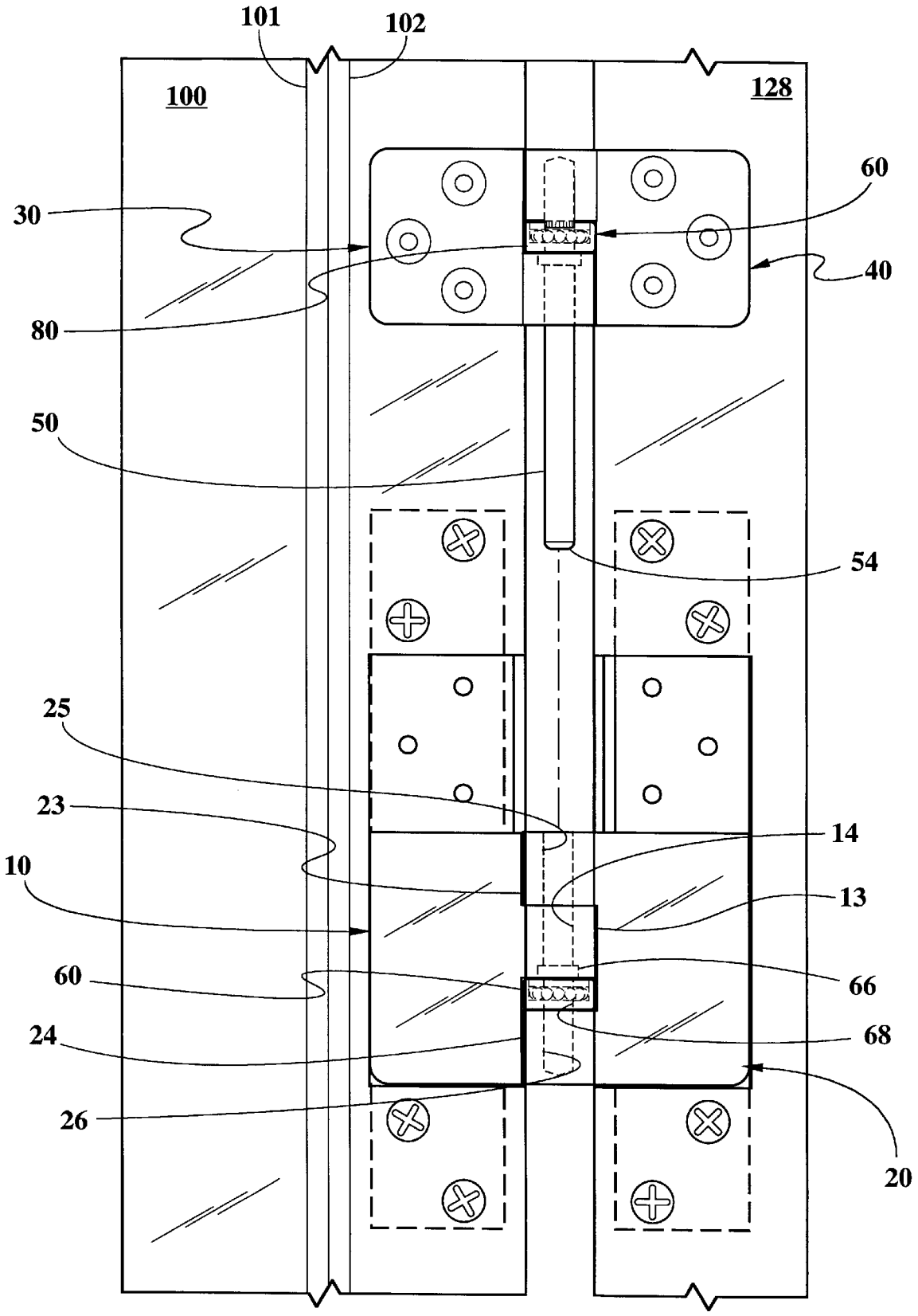
FIG. 17 is a side view showing the door frame filler quarter, door stile filler quarter, and hinge pin being installed onto the mounted door frame strap quarter and door stile strap quarter.

As shown in FIG. 17, the hinge pin assembly 80 with door frame filler quarter 30 and bearing 60 positioned on the hinge pin 50 are installed onto the door frame strap quarter 10 and door stile strap quarter 20. The lower end 54 of the hinge pin 50 is advanced downward through the bore 25 in the upper knuckle 23 of the door stile strap quarter 20, through the bore 14 in the knuckle 13 of the door frame strap quarter 10, through the bore 68 in the sleeve 66 of the bearing 60, and into the clear bore 26 in the lower knuckle 24 of the door stile strap quarter 20.

Figure 18:
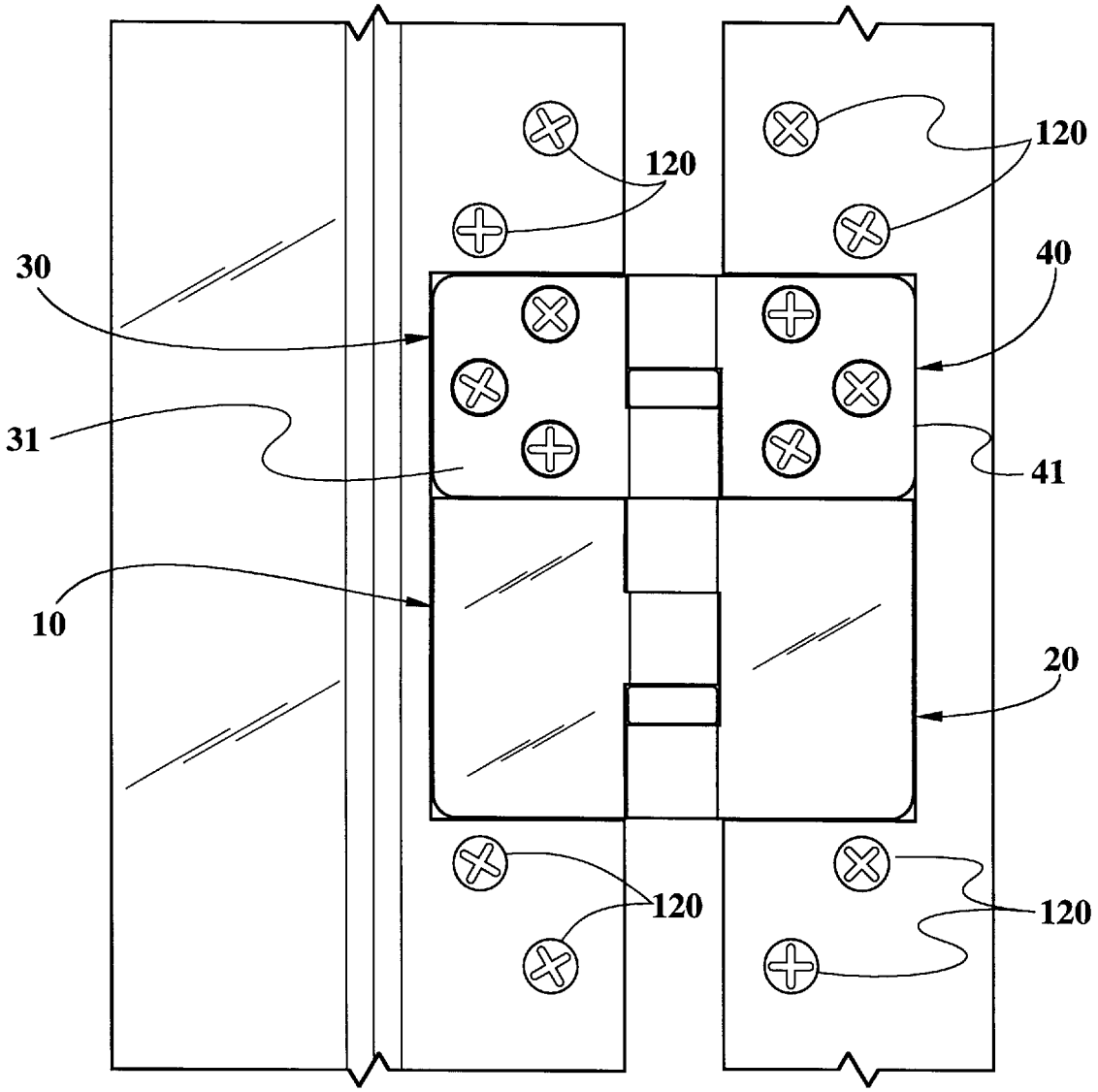
FIG. 18 is a side view showing the improved butt hinge of the disclosed embodiment completely installed on a door stile and door frame.

Finally, as shown in FIG. 18, the door frame filler quarter 30 is pivoted into position against the strap 12 of the door frame strap quarter 10. The holes 35 in the leaf 31 of the door frame filler quarter 30 are aligned with the central threaded mounting holes 17 in the strap 12 of the door frame strap quarter 10 (the strap 12 and holes 17 and 35 are not visible in FIG. 18; refer to FIGS. 1A and 3A). Similarly, the door stile filler quarter 40 is pivoted into position against the strap 22 of the door stile strap quarter 20, the holes 45 in the leaf 41 of the door stile filler quarter 40 being aligned with the threaded central mounting holes 28 in the strap 22 of the door stile strap quarter 20 (the strap 22 and holes 28 and 45 are not visible in FIG. 18; refer to FIGS. 2A and 4A). Threaded fasteners 120 are then used to anchor the door frame filler quarter 30 and door stile filler quarter 40 to their respective strap quarters 10, 20.

The improved butt hinge of the disclosed embodiment provides a number of advantages over prior art butt hinges. Since the butt straps 12, 22 are integrally formed with their respective leaves 11, 21, the tedious step of mounting a separate butt strap within the mortise openings of the door frame and door stile is eliminated, along with the labor-intensive and time-consuming process of driving a screw into the butt strap by which to hold the butt strap in place, then removing the screw once the butt strap is mounted. Also, because the butt strap and hinge are integrally formed, the structural integrity of the hinge is not dependent upon the screw connection between the leaf and the butt strap. There is no need to stock separate butt straps, and the mounting screws for fastening the leaf to the butt strap are eliminated; thus parts handling and installation time are reduced. The butt hinge of the present invention is also non-handed and can be made as either a full mortise or a half mortise hinge.

Installation of the butt straps 12, 22 within their respective mortises is also easier than the process for installing prior art butt straps. Because a leaf and at least one knuckle are formed integrally with each butt strap, the installer can grasp the knuckle of the strap quarter to maneuver the strap quarter into position and to hold it while the screws 120 are inserted. Thus the prior art steps of driving a screw into the butt strap by which the butt strap can be maneuvered and held and the subsequent step of removing the screw after the butt strap is installed are eliminated Another feature of the improved butt hinge of the disclosed embodiment is that the hinge pin 50 is completely concealed. The hinge pin 50 cannot be removed without first opening the door and dismounting the door stile filler quarter 40 from the door stile. Since the screws which secure the door stile filler quarter 40 to the door stile 128 are inaccessible when the door is closed, the hinge pin 50 is inherently non-removeable and needs no separate set screw or locking pin.

The thickness of the leaves 11, 21, 31, and 41 of the door frame strap quarter 10, door frame filler quarter 20, door stile strap quarter 30, and door stile filler quarter 40 have a thickness which makes the leaves flush with the exterior surface of a door frame having a 0.125 inch thick wall. In the event the butt hinge of the disclosed embodiment is mounted in a door frame 100 having a 0.094 inch thick wall, the door frame strap shim 70 is employed to make the leaves 11, 21, 31, and 41 flush with the exterior surface of the door frame. The door frame strap shim 70 is interposed between the upper and lower ends of the butt strap 12 of the door frame strap quarter 10 and the inner surface of the door frame 100, and the threaded fasteners 120 are advanced through the holes 106 in the door frame, through the through bores 74 in the plate 72 of the shim 70, and then threaded into the mounting holes 16, 18 in the butt strap 12.

The improved butt hinge of the disclosed embodiment is non-handed. To install the hinge on a door which is oppositely handed from the door 130 shown in FIGS. 16–18, the strap quarters 10, 20 are installed in an inverted orientation in comparison to the orientation previously described. When the hinge is installed, the leaves 11, 21 of the strap quarters 10, 20 are located above the leaves 31, 41 of the filler quarters 30, 40. The hinge pin 50 is then installed from beneath the hinge assembly.

Finally, it will be understood that the preferred embodiment has been disclosed by way of example, and that other modifications may occur to those skilled in the art without departing from the scope and spirit of the appended claims.

It is claimed:

1. A hinge mounted door comprising:

a door frame comprising a hollow frame member, said hollow frame member having an inner surface, and said door frame defining an opening therein;

a door having a hollow door stile, said door stile having an inner surface, and said door stile defining an opening therein;

a first butt strap mounted to said inner surface of said hollow door frame member, said first butt strap traversing said opening in said hollow door frame member;

a first butt strap leaf formed integrally with said first butt strap, said first butt strap leaf having at least one knuckle, and said first butt strap leaf being disposed within said opening in said hollow door frame member and occupying a portion thereof;

a second butt strap mounted to said inner surface of said hollow door stile, said second butt strap traversing said opening in said hollow door stile;

a second butt strap leaf formed integrally with said second butt strap, said second butt strap leaf having at least one knuckle, and said second butt strap leaf being disposed within said opening in said hollow door stile and occupying a portion thereof;

a first filler quarter mounted to said first butt strap, said first filler quarter comprising a leaf having at least one knuckle, and said leaf of said first filler quarter being disposed within said opening in said hollow door frame member and occupying a portion thereof;

a second filler quarter mounted to said second butt strap, said second filler quarter comprising a leaf having at least one knuckle, and said leaf of said second filler quarter being disposed within said opening in said hollow door stile and occupying a portion thereof;

said knuckles of said first butt strap leaf, said second butt strap leaf, said leaf of said first filler quarter, and said leaf of said second filler quarter being substantially coaxially aligned; and a hinge pin extending through said knuckles to pivotably attach said door to said door frame.

2. The hinge mounted door of claim 1, wherein said hinge pin comprises first and second ends;

wherein said first end of said hinge pin is received within a clear bore in one of said leaf of said first filler quarter and said leaf of said second filler quarter; and wherein said second end of said hinge pin is received within a clear bore in one of said first butt strap leaf and said second butt strap leaf;

whereby said hinge pin cannot be removed from said door and said door frame without first dismounting said at least one of said leaf of said first filler quarter and said leaf of said second filler quarter from its corresponding butt strap, whereby said hinge pin cannot be removed while said door is closed.

3. The hinge mounted door of claim 1, wherein said hollow door frame member has an outer surface;

wherein said hollow door stile has an outer surface;

wherein said first and second butt strap leaves and said leaves of said first and second filler quarters each have an outer surface;

wherein said outer surfaces of said first butt strap leaf and said leaf of said first filler quarter are flush with said outer surface of said hollow door frame member; and wherein said outer surfaces of said second butt strap leaf and said leaf of said second filler quarter are flush with said outer surface of said hollow door stile.

4. The hinge mounted door of claim 3, wherein said hollow door frame member has a predetermined thickness;

wherein said hollow door stile has a predetermined thickness;

wherein said first butt strap leaf and said leaf of said first filler quarter each have a thickness substantially corresponding to said predetermined thickness of said hollow door frame member;

wherein said second butt strap leaf and said leaf of said second filler quarter each have a thickness substantially corresponding to said predetermined thickness of said hollow door stile; and wherein said first butt strap is mounted flush to said inner surface of said hollow door frame member.

5. The hinge mounted door of claim 3, wherein said hollow door frame member has a predetermined thickness;

wherein said first butt strap leaf and said leaf of said first filler quarter each have a thickness greater than said predetermined thickness of said hollow door frame member; and wherein said pivotably mounted door further comprises a shim interposed between said first butt strap and said inner surface of said hollow door frame member, said shim being configured such that said first butt strap leaf and said leaf of said first filler quarter are flush with said outer surface of said hollow door frame member.

* * * * *

UNITED STATES PATENT AND TRADEMARK OFFICE

CERTIFICATE OF CORRECTION

PATENT NO. : 5,819,372

DATED : October 13,1998

INVENTOR(S) : Robert Dean Magoon

It is certified that error appears in the above-identified patent and that said Letters Patent is hereby corrected as shown below:

On the title page, item[73] delete the following:

"Microsoft Corporation, Redmond, Washington"

and insert in place thereof -- Kawneer Company, Inc., Norcross, Georgia --.

Signed and Sealed this

Thirteenth Day of July, 1999

*Attest:*

Q. TODD DICKINSON

*Attesting Officer*

*Acting Commissioner of Patents and Trademarks*